US005172171A

United States Patent [19]

Beaudet et al.

[11] Patent Number: 5,172,171

[45] Date of Patent: Dec. 15, 1992

[54] HIGH SPEED APPARATUS FOR DEVELOPING ELECTROSTATIC IMAGES USING SINGLE COMPONENT NONCONDUCTIVE, NONMAGNETIC TONER

[76] Inventors: Leo A. Beaudet, 44 Water St.; Robert O. Kaplan, 12 Edgewood Rd., both of Milford, Mass. 01757

[21] Appl. No.: 873,617

[22] Filed: Apr. 22, 1992

Related U.S. Application Data

[63] Continuation of Ser. No. 621,669, Dec. 3, 1990, abandoned.

[51] Int. Cl.[5] ..... G03G 15/06

[52] U.S. Cl. ..... 355/261; 355/215

[58] Field of Search ..... 355/215, 245, 259, 261, 355/265; 118/656, 661

[56] References Cited

U.S. PATENT DOCUMENTS

| | | | |
|---|---|---|---|
| 3,669,073 | 6/1972 | Savit et al. | 118/637 |
| 3,893,418 | 7/1975 | Liebman et al. | 355/259 X |
| 4,260,235 | 4/1981 | Stack | 355/296 X |
| 4,410,259 | 10/1983 | Yamagata et al. | 355/259 |
| 4,653,426 | 3/1987 | Kohyama | 118/653 X |
| 4,666,282 | 5/1987 | Rowe | 355/215 |
| 4,697,914 | 10/1987 | Hauser | 355/296 X |
| 4,847,653 | 7/1989 | Doi et al. | 355/259 X |

FOREIGN PATENT DOCUMENTS

| | | | |
|---|---|---|---|
| 0217965 | 12/1983 | Japan | 355/215 |
| 0052667 | 3/1986 | Japan | 355/261 |

*Primary Examiner*—A. T. Grimley
*Assistant Examiner*—Christopher Horgan
*Attorney, Agent, or Firm*—Lahive & Cockfield

[57] ABSTRACT

An apparatus for charging insulating, nonmagnetic toner particles includes a semiconductive, elastomeric toner applicator roll in rolling contact with the dielectric or photoconductive drum which carries the electrostatic image to be developed. Toner is metered onto the surface of the toner roll and tribocharged, and the toner-bearing roll is rotated past a field electrode which repels airborne toner back to the toner applicator roll. A vacuum housing is placed in proximity to the field electrode to collect airborne toner. The field electrode is maintained at a direct current potential which is below the value required to cause corona discharges to the toner roll surface.

16 Claims, 3 Drawing Sheets

HIGH SPEED APPARATUS FOR DEVELOPING ELECTROSTATIC IMAGES USING SINGLE COMPONENT NONCONDUCTIVE, NONMAGNETIC TONER

This application is a continuation of application Ser. No. 621,669, filed Dec. 3, 1990, now abandoned.

The present invention is generally related to method and apparatus for developing electrostatic images using charged toner particles, and more particularly to high speed developing apparatus suited for use with single component, nonconductive, nonmagnetic toner.

Numerous methods are well known for the development of electrostatic images. In several of these methods, toner particles are deposited onto an electrostatic latent image present on an electrically insulating surface, using, for example, cascade development, magnetic brush development, powder cloud development, and touchdown development. In view of several disadvantages of two-component toning systems, considerable effort has been directed to designing systems which employ toner particles only. U.S. Pat. No. 3,152,012 to R. M. Schaffert is illustrative of touchdown development apparatus using single component toner.

In certain of the single component development processes, conductive toner particles are used, and imagewise toner deposition onto a photoconductive or dielectric member occurs by inductive charging of the toner particles. Often, such systems have required a special overcoated insulating paper in order to permit electrostatic transfer of the toner image. Such conductive toner systems have also suffered undesirable background imaging problems, due to inherent shortcomings of the inductive charging process. This is not so great a problem for two-component toning systems, in which electrostatic forces acting on the triboelectrically charged toner particles reduce background imaging.

Recent years have seen a movement toward systems employing electrically insulative, nonmagnetic, single component toning. Such systems, as exemplified by the apparatus of the present invention, can be simple yet efficient, and permit color toning and two-component image quality. In development systems such as shown in U.S. Pat. Nos. 4,459,009 and 4,764,841, a charging roll simultaneously meters and tribocharges toner particles onto a toner applicator roll. The toner applicator roll carries the toner particles to a development zone, for transfer to a photoconductive or dielectric drum via touchdown development. U.S. Pat. No. 4,764,841 discloses the use of an applicator roll having a surface layer of silicone resin with conductive particles therein. Among the challenges in systems of this type, particularly when operated at high speeds, are providing efficient toning with high toner yields and excellent image quality.

Accordingly, it is a principal object of the invention to provide for high speed development of electrostatic images. Related objects are simplicity of design and operation, with efficient use of the toner.

An additional object is the design of a toning system for use with electrically insulative, nonmagnetic, single component toners.

A further object is to develop latent electrostatic images having limited charging potentials.

SUMMARY OF THE INVENTION

The above and additional objects are realized in the development apparatus of the invention, in which toner particles are metered onto the surface of an applicator member, and charged, then brought into an area of proximity with a dielectric member to develop electrostatic images thereon. A field electrode is placed in proximity to the applicator member intermediate the site of depositing toner particles onto the applicator member and the area of proximity to the dielectric member. The field electrode is maintained at a DC potential of like polarity as the desired charge on the toner particles, and below the corona threshold potential, to repel airborne toner particles back toward the surface of the applicator member. The apparatus of the invention is of particular utility in high speed single component, nonconductive, nonmagnetic toner systems. The development systems embodying the invention have been shown capable of running at speeds in excess of 100 inches per second (2.5 meters per second), with typical operating ranges of 60–80 inches per second (1.5–2.0 meters per second).

In accordance with one aspect of the invention, the field electrode may be placed above the surface of the applicator member and just beyond a tribocharging device thereby to counteract a tendency of toner to leave the surface of the applicator member. There may be a single tribocharging device, such as a roller or a blade, which also meters the toner onto the applicator member, or one or more supplementary such devices may be employed.

Advantageously, a vacuum housing located in the vicinity of the field electrode collects any airborne toner which has not been driven back to the toner applicator member by the field electrode. In particular, the vacuum housing can collect toner particles which have been charged oppositely to the desired polarity, i.e., opposite to the polarity of the field electrode. Applicant has observed that the use of a field electrode markedly improves toner yield, i.e., reduces the percentage of toner which is collected by the vacuum housing to the extent that recycling collected toner is unnecessary.

Most preferably, the applicator member and dielectric member are cylinders in rolling contact with each other, providing touchdown development. These cylinders may rotate at matching surface speeds, or a speed differential may be provided, as known in the prior art. Differential speed may also be provided by skewing the toner applicator roll relative to the dielectric cylinder when driving the former member from the latter.

In the preferred embodiment of the invention, the image development system is employed as part of a high speed electrostatic printer in accordance with U.S. Pat. Nos. 4,267,556; 4,365,549; and 4,894,687. Typically, the latent electrostatic images to be developed are negatively charged images at a potential in the range −150 volts−−250 volts. Depending upon the toner employed, the toner applicator roll would be biased at a potential between around −75 volts to −250 volts.

BRIEF DESCRIPTION OF THE DRAWINGS

The above and additional aspects of the invention are illustrated in the detailed description of a preferred toning system which follows, taken in conjunction with the drawings in which.

DETAILED DESCRIPTION

Figure 1:
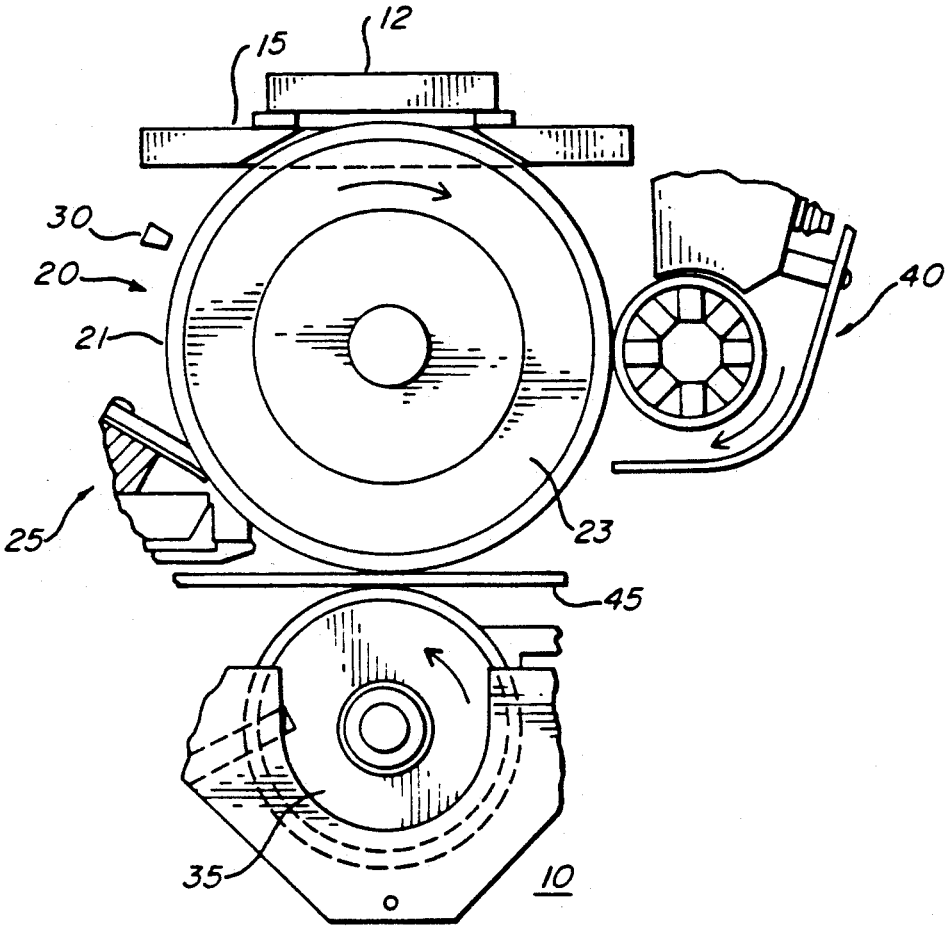
FIG. 1 (PRIOR ART)
FIG. 1 is a partial schematic view of a prior art high speed electrographic printer.

The image development system of the invention enjoys particular utility in high speed electrostatic printing and copying apparatus. For example, such development system may be incorporated to advantage in electrostatic transfer printing apparatus as disclosed in U.S. Pat. Nos. 4,267,556; 4,365,549 and 4,894,687, all of which are incorporated by reference herein. Having reference to FIG. 1, high speed printing system 10 includes a print head 12 mounted on support 15 for depositing charged particles (ions and electrons) on a dielectric surface layer 21 of imaging cylinder 20 to form a latent electrostatic image. Toning or developing station 40 supplies toner particles to the cylinder to create a visible counterpart of the latent electrostatic image. Transfer roller 35 is in rolling contact with imaging cylinder 20 under high pressure to transfer and simultaneously fuse the toner particles to a receptor sheet or web 45. As taught in U.S. Pat. No. 4,894,687, the imaging cylinders 20 may be skewed relative to transfer roller 35 to improve toner transfer efficiency to the receptor medium 45. Scraper blade 25 removes residual toner particles, while erase head 30 erases or reduces any residual charge on the dielectric surface layer 21.

In the prior art printing system of U.S. Pat. No. 4,365,549, toning system 40 utilized single component conducting magnetic toner of the type described by J. C. Wilson, U.S. Pat. No. 2,846,333, issued Aug. 5, 1958. Single component toning apparatus 40 was essentially identical to that employed in the Develop KG Dr. Eisbein and Company (Stuttgart) No. 444 copier.

The present invention provides improved image development apparatus which may be employed, for example, in the high speed electrographic printer 10 of FIG. 1. Typically, in such systems, the latent electrostatic images to be developed are formed at negative potentials in the range from about 150 volts to 250 volts—relatively low values compared to the charge values of many electrophotographic systems. The image development systems discussed below have been found to provide high quality toned images and high toner yields, while being capable of high speed operation. Toning speeds upwards of 100 inches per second (2.5 meters per second), measuring the speed of image receptor 45 through the nip between rollers 20 and 35, have been achieved, with a typical operating range being about 60–80 inches per second (1.5–2.0 meters per second).

Figure 2:
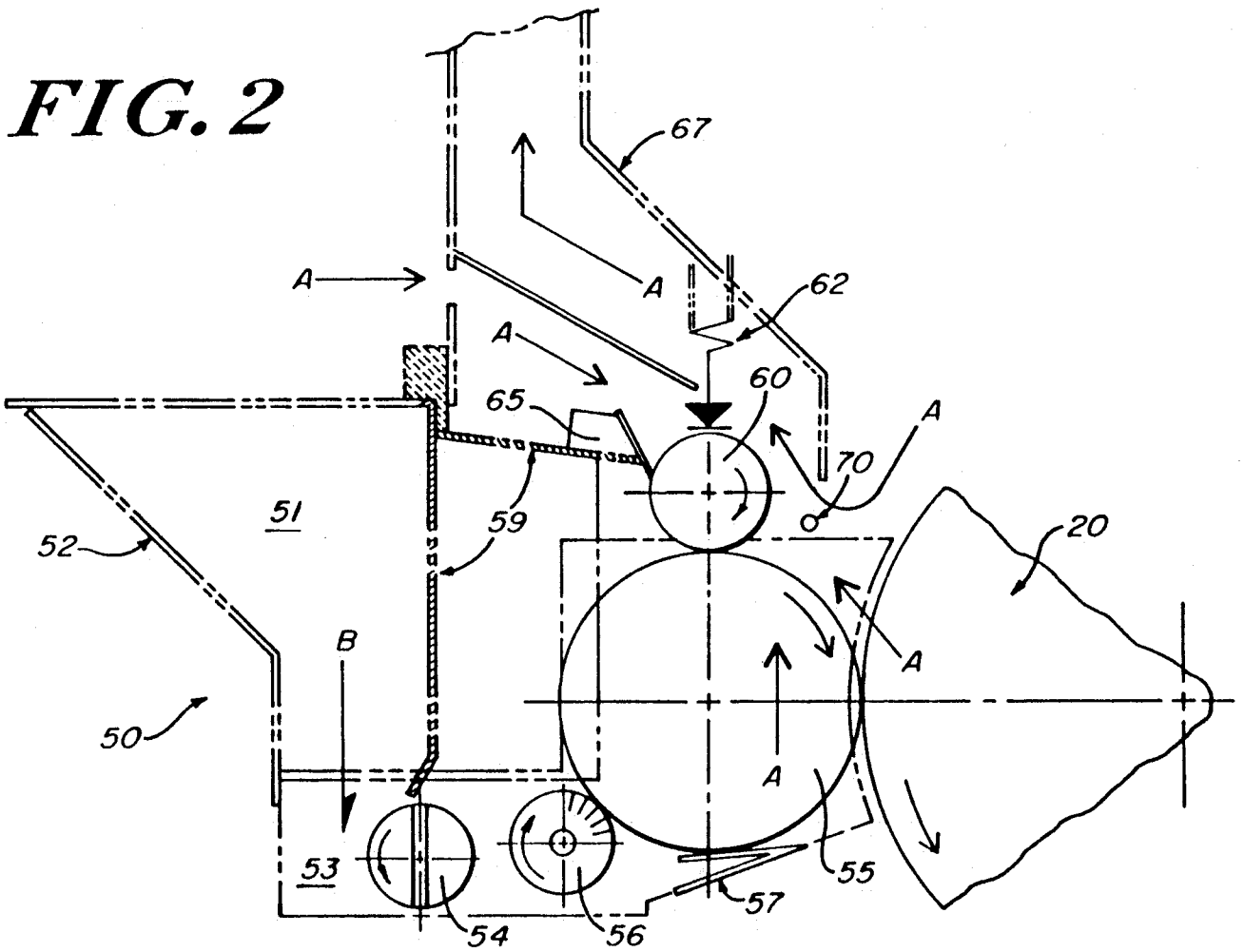
FIG. 2 is a highly schematic diagram of a development system in accordance with a first embodiment of the invention.

FIG. 2 illustrates in highly schematic form a development assembly 50 embodying the invention. Toner particles are supplied to a toner hopper 52, where they are fed by gravity in direction B from an upper toner hopper area 51 (defined in part by barrier 59) to a lower area 53. Advantageously, the toner is of the single component, nonmagnetic, nonconducting type. In the preferred embodiment in which the latent electrostatic image on dielectric cylinder 20 is of a negative charge, the toner is chosen and development system 50 is designed to positively charge the toner. In an alternative embodiment in which the development system was used to render visible positively charged latent electrostatic images on a photoconductor, the toner would be negatively charged. In the lower hopper zone 53, the toner particles are agitated by auger 54 to reduce toner particle agglomeration, and fed to a nylon replenisher brush 56 which meters toner onto toner applicator roll 55 while simultaneously tribocharging the deposited toner. Nylon brush 56, which rotates counter to the rotation of toner applicator roll 55 at approximately the same surface speed, applies a light load to roll 55 to reduce torque, as is desirable for high speed operation. Illustratively, replenisher brush 56 deposits an approximately 2–4 mm. thick layer of toner on applicator roll 55. Auger 54, nylon brush 56, and other mechanisms of system 50 are provided with sealed bearings for more reliable operation.

Blades 57 prevent toner particles from backing out of the lower toner area 53 into the zone adjacent dielectric cylinder 20.

Figure 4:
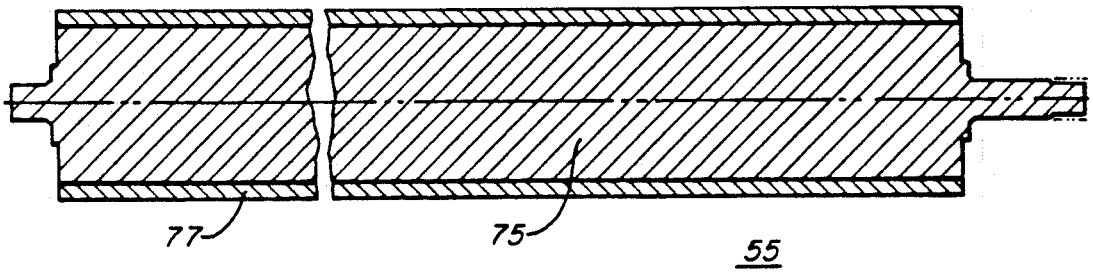
FIG. 4 is a sectional view of the toner applicator roll from the development system of FIGS. 2 and 3.

Having reference to FIG. 4, a preferred form of applicator roll 55 incorporates an elastomeric, semiconductive surface layer 77 over a conductive core 75. The preferred material for elastomeric surface layer 77 is silicone rubber of a durometer hardness in the range 45–65 Shore "A", preferably 50–60. The silicone elastomer is loaded with carbon black particles to provide a volume resistivity in the range $10^3$–$10^8$ ohm-cm, with $10^3$–$10^5$ ohm-cm being the preferred range as this is observed to provide more consistency of volume resistivity in manufacture. Alternative elastomers include neoprene, styrene butadiene, and chlorosulfonated polyethylene (HYPALON, E. I. DuPont deNemours and Company's trademark for this type of synthetic rubber). It has also been observed that the applicator roll should have a smooth surface finish for best imaging characteristics. The silicone elastomer tends to form a monolayer of toner particles which in turn collect additional particle layers.

The applicator roll 55 may be frictionally driven by contact with the dielectric cylinder 20, which has a very hard, smooth surface. Preferably, however, rollers 20 and 55 are separately driven at matching or slightly different surface speeds. In an operative embodiment, toner applicator roll 55 was driven at 10–15% higher speed than dielectric cylinder 20.

Referring again to FIG. 2, toner particles on the surface of applicator roll 55 are charged and further metered by a charging roll 60, illustratively comprising a ground steel roll. Roll 60 is spring loaded at 62 into contact with the applicator roll 55, and is cleaned using plastic doctor blade assembly 65. Charging roll 60 was maintained at the same potential as the toner applicator roll 55.

Charged toner particles on the surface of toner applicator roll 55 emerging from the nip with charging roll 60 have been observed to show propensity to become airborne, particularly at high surface speeds. This effect causes toner contamination of the system components and inefficient use of toner, with more than 25 percent of the toner particles being collected by a vacuum head placed downstream of the tribocharging/metering device. This effect appears to be due to air velocity past the toner surface layer, rather than centrifugal force. In experimental attempts to control positively tribocharged toner particles on the surface of applicator roll 55, applicant has tried using a corona wire to overcome the air velocity and push toner back to the surface of roll 55. Such a corona wire has been observed to over-charge the toner particles, causing excessive buildup of toner on the surface of the toner roll, and more prominent background images. (See example 2).

Best results have been achieved using a field electrode 70 placed near the nip between charging roll 60 and applicator roll 55, maintained at a direct current potential of like polarity as the intended charge on the toner particles (in the preferred embodiment, positive). By maintaining the field electrode substantially below the corona threshold potential, the overcharging problem is avoided. In an illustrative embodiment, a 10 mil copper wire field electrode was operated at various potentials between 2 and 6 kilovolts, well below the corona threshold potential for a wire this size. Toner yields were dramatically improved, with less than 5 percent of toner by weight being collected by the vacuum housing, as compared with about 30 percent in the absence of the field electrode, at an operating speed of 300 feet per minute (1.5 meters per second). It has been observed that toner particles which were charged negative rather than the desired positive charge, are attracted to the field electrode, then collected by the vacuum chamber 67.

The various arrows A indicate air flow in toning system 50. An upward air flow is established from the base of assembly 50 and from dielectric cylinder 20 to prevent various parts from overheating (causing toner fusing) or becoming contaminated. Air is drawn past the charging roller assembly 60 and field electrode 70 by the vacuum chamber 67, ensuring system cleanliness.

Figure 3:
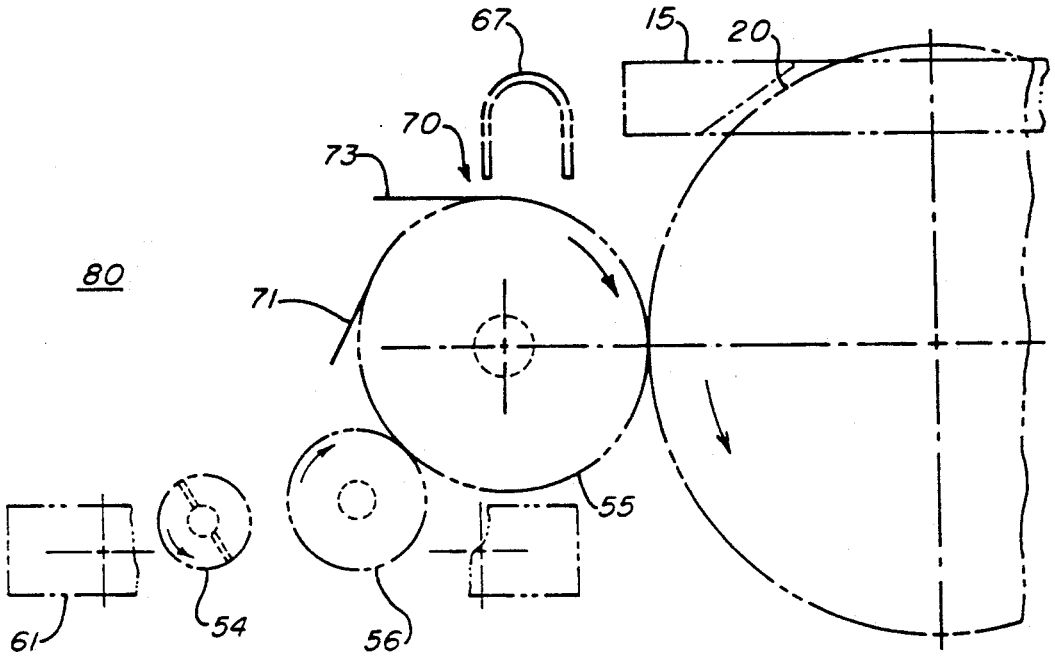
FIG. 3 is a partial schematic diagram of an alternative development system according to the invention.

FIG. 3 illustrates a second image development system configuration 80, wherein the charging roll 60 is replaced by a pair of charging/metering blades 71, 73. The use of charging blades has the advantages of economy and avoiding the higher torque exerted on the toner applicator roll by roller charging, undesirable at high operating speeds. It is important to employ nonmagnetic single component toner formulas which will not stick to the blades during high speed operation.

EXAMPLE 1

In an operative embodiment of the toning system 80 of FIG. 3, a carbon black loaded silicone elastomer toner roll 55 (Ames Rubber Co., Hamburg, N.H. 07419) was used having a volume resistivity measured at $10^4$ohm-centimeters. 2.8 inch diameter applicator roll 55 was rotated at 330 feet per minute, ten percent faster than the 300 feet per minute surface speed of dielectric cylinder 20; the drive mechanism for the toner applicator roll 55 was slaved from the drive for dielectric cylinder 20, with the rolls being slightly biased toward each other. Auger 54 was geared to replenisher roll 56 to operate at the same rotational speed. Dielectric cylinder 20 was hardcoat anodized aluminum the pores of which were impregnated with carnauba wax, followed by polishing to 10 microinch rms surface finish, in accordance with U.S. Pat. No. 4,518,468. A 1.0 inch (2.5 cm) diameter nylon replenisher brush 56 was rotated at the same surface speed, 330 feet per second, as applicator roll 55. Reverse acting steel tribocharging/metering blades were maintained in light contact with the applicator roll 55. The toner employed was Nashua Kodak KT-1 nonmagnetic single component toner of Nashua Office Products, Nashua, N.H. 03061, while the image receptor medium 45 was OCR coated 50# English Finish slip stock, of Wyomissing Corp., Reading, Pa. 19603.

A 0.01 inch (0.25 mm) diameter field electrode 70 was placed 0.4 inches (1.0 cm) above the tip of metering blade 73, and 0.1 inch (2.5 mm) from the rim of vacuum housing 67. Field electrode 70 was maintained at a positive direct potential of 4.0 KV. Latent electrostatic images on the dielectric cylinder 20 were measured at negative potentials in the range 150 to 250 volts. The toner applicator roll conductive core 75 was maintained at a negative bias potential of 100 volts.

Toner collected by the vacuum housing 67 with or without the field electrode was measured by weighing a vacuum bag and fixture both before and after collecting toner. The use of the field electrode resulted in 86% less collected toner by weight.

EXAMPLE 2

The toning system of Example 1 was operated with the toner applicator roll surface speed reduced to 100 fee per minute. A 3 mil diameter wire was used for field electrode 70. Print samples were taken at various potentials of the field electrode. At 3 kilovolts, normal printing was observed. At 4 kilovolts, the print became slightly denser, with slight background observed. At 5 kilovolts, background streaks were observed. At 6 kilvolts, very pronounced background was seen. Reduction of the field electrode potential back to 5 kilovolts improved but did not eliminate background problems.

We claim:

1. An improved electrostatic development apparatus for developing latent electrostatic images on an electrostatic latent image surface that moves in a predetermined direction, comprising a donor member contacting or closely spaced from said electrostatic latent image surface and adapted to receive single component, non-magnetic toner and to deliver the toner to said electrostatic latent image surface as said donor member moves in order past a first, a second and a third position;

means for supplying single component, non-magnetic toner to the surface of said donor member at said first position;

means for charging to a desired charge polarity said toner on the surface of said donor member at said second position, the donor member delivering the charged toner to said electrostatic latent image surface at said third position; and field electrode means in the vicinity of said donor member and of said charging means beyond said second position, said field electrode means being positioned and maintained at a direct current potential to electrostatically repel toner of the desired charge polarity escaping from the surface of the donor member back toward the surface of said donor member enhancing delivery of charged toner to the image surface at the third position.

2. Apparatus as defined in claim 1, wherein the charging means charges the toner to a predetermined desired polarity, and the direct current potential of the field electrode is of a like polarity.

3. Apparatus as defined in claim 1, wherein the direct current potential of the field electrode is maintained at a voltage substantially greater than that of charged toner, but substantially below the threshold potential to cause corona discharges to the donor member and to toner on the donor member surface.

4. Apparatus as defined in claim 1, further comprising collection means adjacent the field electrode, for collecting airborne toner particles.

5. Apparatus as defined in claim 4, wherein the collection means is a vacuum chamber having an orifice adjacent to the field electrode.

6. Apparatus as defined in claim 5 wherein the vacuum chamber orifice is located beyond the field electrode in a direction of surface motion of the donor member.

7. Apparatus as defined in claim 1 wherein the field electrode is a wire.

8. Apparatus as defined in claim 7 wherein the direct current potential of the wire is below the threshold potential to cause corona discharges to the donor member and to toner on the donor member surface.

9. Apparatus as defined in claim 1, wherein the donor member has an elastomeric, semiconductive surface layer.

10. Apparatus as defined in claim 1, wherein the electrostatic latent imaging surface and donor member are rollers in rolling contact with each other.

11. Apparatus as defined in claim 1, wherein the donor member is a rotating drum having a semiconductive and elastomeric surface that rotates into contact with said electrostatic latent image surface at said third position.

12. Apparatus as defined in claim 11, wherein the field electrode means includes a wire parallel to the surface of the donor member, and maintained at a potential of between two and six kilovolts.

13. Apparatus as defined in claim 11, wherein the means for charging includes a conductive trailing member biased toward the surface of the donor member and impressed with a potential for contact charging a nonconductive toner.

14. Apparatus as defined in claim 11, wherein the donor member rotates past the imaging surface at a surface speed greater than the speed of the imaging member.

15. Apparatus as defined in claim 1, wherein the donor member delivers toner to the imaging surface moving at a rate in excess of approximately 1.0 meters per second.

16. Apparatus as defined in claim 4, wherein a major portion of toner particles of same charge polarity as the field electrode means are repelled back toward the donor member, while a minor portion of toner particles of opposite polarity contact the field electrode and are then driven toward the collection means.

* * * * *